US005617465A

United States Patent [19]

Bucher

[11] Patent Number: 5,617,465

[45] Date of Patent: Apr. 1, 1997

[54] SCAN-TYPE X-RAY IMAGING WITH FIXED CONVERTER

[75] Inventor: Hans R. Bucher, Boulder, Colo.

[73] Assignee: Xedar Corporation, Boulder, Colo.

[21] Appl. No.: 569,570

[22] Filed: Dec. 8, 1995

[51] Int. Cl.[6] ..... G21K 5/10

[52] U.S. Cl. ..... 378/146; 378/98.3

[58] Field of Search ..... 378/146, 98.3

[56] References Cited

U.S. PATENT DOCUMENTS

| | | | |
|---|---|---|---|
| 4,179,100 | 12/1979 | Sashen et al. | 378/146 |
| 4,383,327 | 5/1983 | Kruger | 378/146 |
| 4,709,382 | 11/1987 | Sones . | |
| 4,845,731 | 7/1989 | Vidmar et al. . | |
| 4,998,270 | 3/1991 | Scheid et al. . | |
| 5,142,557 | 8/1992 | Toker et al. . | |
| 5,216,250 | 6/1993 | Pellegrino et al. . | |
| 5,289,520 | 2/1994 | Pellegrino et al. . | |

*Primary Examiner*—Craig E. Church
*Attorney, Agent, or Firm*—Robert E. Harris

[57] ABSTRACT

A scan-type X-ray imaging system and method are disclosed. Image detection is effected by use of a fixed phosphor converter screen covering the entire field of view so that X-rays passed through an object, or a body portion, positioned at a scan area, are received at the converter screen and light signals, proportional to the received X-rays, are coupled through a movable coupler, having an input portion movably engaging the converter screen, to a movable sensor that converts received light signals to electrical output signals indicative of the object, or body portion, then at the scan area. The input face of the coupler, preferably a fiber optic coupler, is held in positive engagement with the converter screen throughout movement of the coupler relative to the converter screen by a force, such as by an air cushion between the object, or body portion, positioner and the converter screen, by establishing a vacuum between the input face of the coupler and the converter screen, and/or by springs biasing the coupler face plate toward engagement with the converter screen.

20 Claims, 3 Drawing Sheets

SCAN-TYPE X-RAY IMAGING WITH FIXED CONVERTER

FIELD OF THE INVENTION

This invention relates to an X-ray imaging system and method, and, more particularly, relates to a scan-type X-ray imaging system and method having a fixed converter screen.

BACKGROUND OF THE INVENTION

The use of X-ray imaging systems is well known for use in diverse fields, including utilization in connection with medical diagnosis and/or procedures. Such systems have included fixed-type imaging systems wherein the X-ray source and sensor are maintained in fixed positions to image a body portion within a field of view (FOV) at a scan area (see, for example, U.S. Pat. No. 5,142,557 to Toker et al.) and scan-type imaging systems wherein the X-ray source and/or sensor are moved to image a body portion within a field of view (FOV) at a scan area (see, for example, U.S. Pat. Nos. 4,709,382 to Sones and 4,998,270 to Scheid et al.).

In addition, X-ray imaging systems have also included full field film-type readout units therein an image is recorded on a film cassette or the like (see, for example, U.S. Pat. No. 4,998,270 to Scheid et al.), as well as electronic readout units wherein electrical signals indicative of an image are normally converted to digital signals and the digital signals are then used to display and/or electronically store the image (see, for example, U.S. Pat. Nos. 5,142,557 to Toker et al. and 5,289,520 to Pellegrino et al.).

Such systems normally require a converter, such as a phosphor converter screen, to form and provide light signals responsive, and proportional, to received X-rays passed through the body portion then subjected to X-rays, and electronic readout systems require the converted signals (i.e., the light signals converted from the X-rays) to be coupled, normally through a coupler, such as a fiber optic (OF) coupler, to a sensor, such as a charge coupled device (CCD) or preferably a time delay integrated (TDI) CCD, providing electrical signal outputs responsive to received light signals.

In electronic diagnostic X-ray imaging applications, it has been found to be impractical to attempt to instantaneously image large fields of view since large FOV systems require one or both of very large CCDs or very large fiber optic (OF) reducers, making such sensors impossible, or at least quite expensive, to produce.

While the problem of obtaining a large FOV might be overcome by using lens based systems with large magnification, such systems would be subject to being excessively lossy, requiring an increase in patient dosage of X-rays in order to obtain a satisfactory signal-to-noise ratio (SNR) for the system.

Optically coupled system shortcomings might also be solved, at least in part, by the use of a slit scanner using either one or a multiple number of CCDs working in the time delay integrated (TDI) mode. In general, these TDI-CCDs are bonded to a OF-Reducer on whose front surface an X-ray phosphor is mounted, and this single, or multistage, TDI-CCD-FO-Phosphor assembly is then mechanically scanned while the charge accumulated in the TDI-sensor is manipulated by vertical transport phases synchronous to the mechanical scan. The use of a layer of phosphor over the entirety of a photodiode array without relative movement therebetween is shown, for example, in U.S. Pat. Nos. 4,709,382 to Sones and 4,845,731 to Vidmar et al.

A difficulty arises with respect to the above approach, however, if the phosphor moving under the object, or body portion, to be imaged has an appreciable decay time with respect to the time of motion (a short decay time is required of the X-ray phosphor in order to avoid smear to obtain high modulation within the image). If the decay time is appreciable, then smear, and therefore a significant loss of modulation of the signal (i.e., loss of resolution) is experienced. Since diagnostic X-ray imaging, for example, is of low contrast, any loss of modulation is also a loss of contrast and therefore is unacceptable.

Also, the scanning speed that can be obtained is limited by the X-ray to visible light conversion efficiency of the phosphor and the phosphor converter output decay time. In general, short decay time phosphors have a poor conversion efficiency and poor resolution. Some of these shortcomings, however, might be at least partially overcome by using exotic phosphor systems.

Thus, the reason that high efficiency short decay time X-ray phosphors are needed for TDI-CCD applications is the necessity to move the phosphor with the sensor. If only the sensor is moved and the X-ray phosphor remains stationary, the decay time of the phosphor is immaterial.

Obviously, an X-ray imaging system that does not require movement of the phosphor along with the sensor, thus removing the necessity for short decay time X-ray phosphors (since the decay time of the phosphor would then be immaterial), would be advantageous.

SUMMARY OF THE INVENTION

A scan-type X-ray imaging system and method are provided with the system including a fixed, or stationary, converter screen, preferably a phosphor screen, and a movable sensor, preferably including at least one charge coupled device (CCD) sensor, with signal coupling from the converter to the sensor being through a coupler, preferably a fiber optic (FO) coupler, having an input portion, or face, that movably engages the converter screen.

Positive engagement of the input face of the coupler with the fixed converter screen is maintained, throughout the entire scanning movement of the sensor and coupler, by a force, such as use of a cushion, preferably an air cushion, between the object, or body portion, positioner and the converter screen, with alternate (or additional) positive engagement being effected by a force, such as by use of a vacuum between the input face of the coupler and the converter screen, and/or by a force, such as by use of springs to bias the input face of the coupler toward engagement with the converter screen.

It is therefore an object of this invention to provide a scan-type X-ray imaging system with a fixed converter.

It is another object of this invention to provide an X-ray imaging system and method having a fixed converter screen and a movable sensor/coupler unit.

It is still another object of this invention to provide a scan-type imaging system and method having a fixed converter screen and a coupler that movably engages the fixed converter screen.

It is still another object of this invention to provide a scan-type imaging system and method having a sensor connected with a coupler having an input portion maintained in positive engagement with a fixed converter screen during the entire scanning movement of the sensor and coupler.

It is still another object of this invention to provide an X-ray imaging system and method having a movable sensor/coupler with the coupler having an input face that is maintained in positive engagement with a fixed converter screen through the use of a force, such as provided by one or more of an air cushion, a vacuum, and springs.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiments of the herein disclosed invention are meant to be included as come within the scope of the claims.

BRIEF DESCRIPTION OF THE DRAWINGS

The accompanying drawings illustrate complete embodiments of the invention according to the best mode so far devised for the practical application of the principles thereof, and in which.

DESCRIPTION OF THE INVENTION

Figure 1:
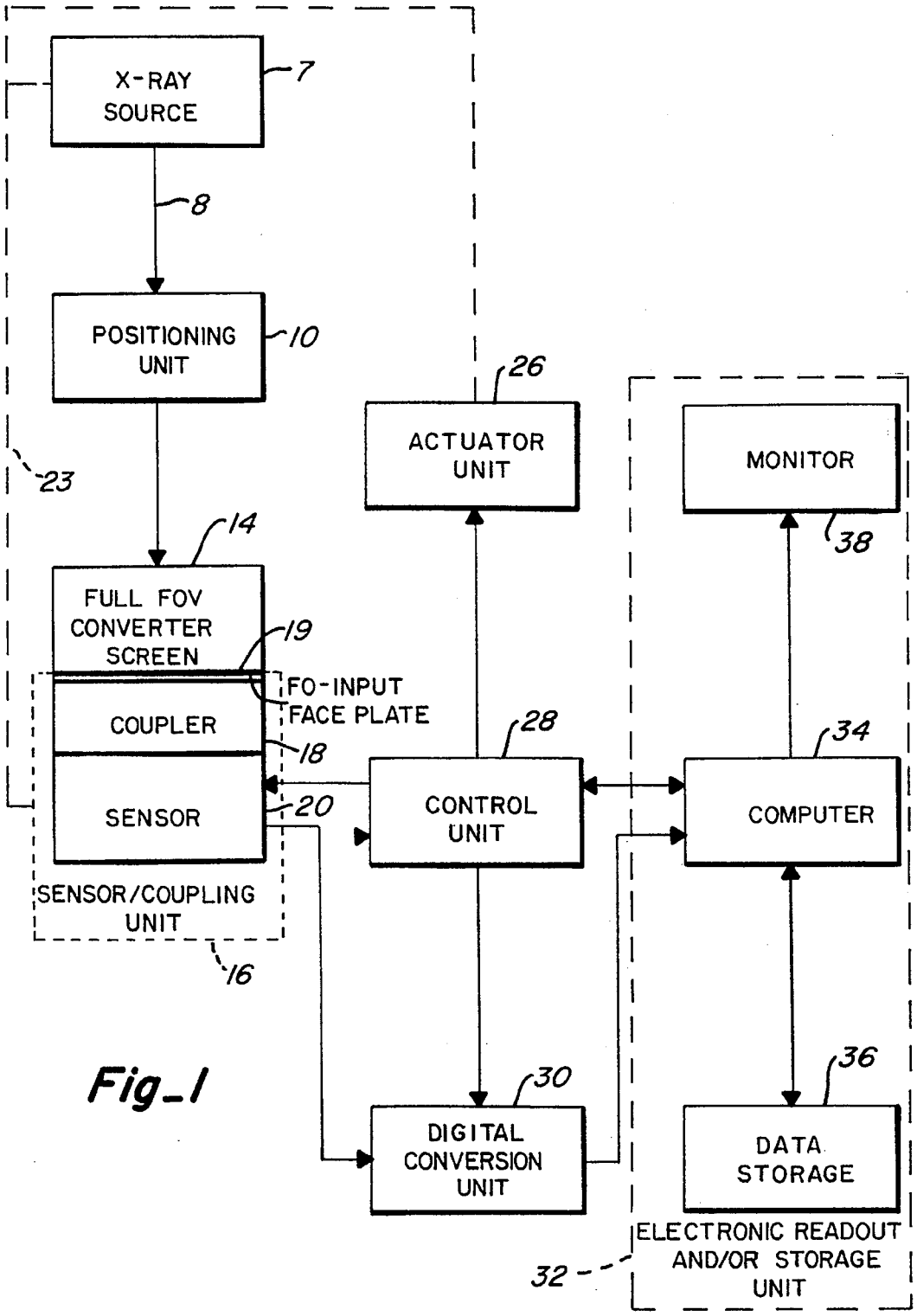
FIG. 1 is a simplified block diagram of an X-ray imaging system with a fixed convertor and a movable coupler according to this invention.
Figure 2:
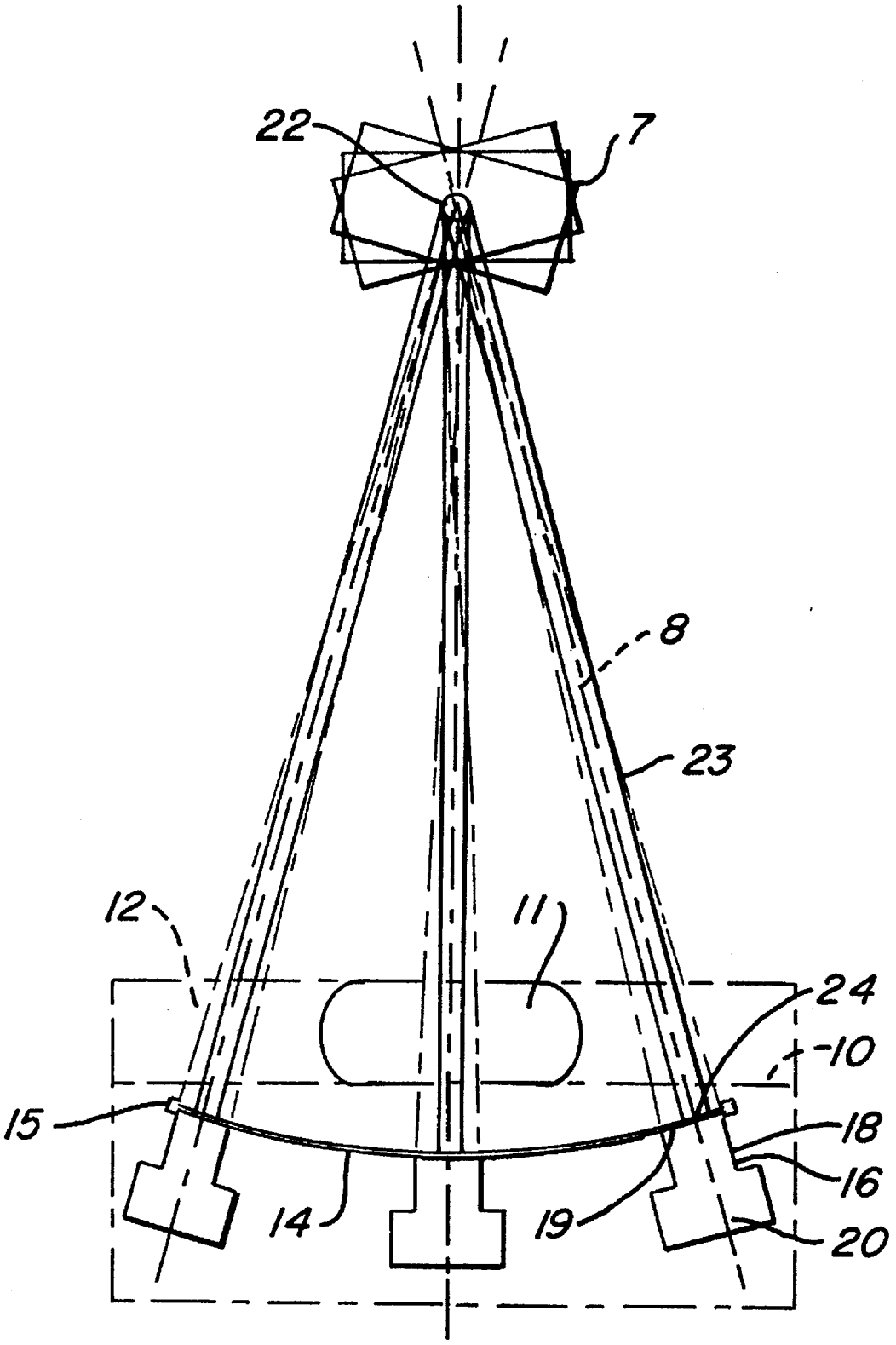
FIG. 2 is a partial side view illustrating movement of a sensor/coupler relative to a converter screen according to this invention.

As illustrated in FIG. 1 in conjunction with FIG. 2, X-ray source 7 provides an X-ray output, or beam, 8 that is directed to a positioning unit 10 positioning an object, or a body portion, 11 at a scan area 12. X-rays passing through the object, or body portion, 11 are received at fixed, or stationary, X-ray converter screen 14, preferably a standard high efficiency phosphor converter screen having the size of the field of view (FOV) to be scanned, with the converter screen being mounted in holder 15 so that the converter screen is a curved membrane, as indicated in FIG. 2.

Light signals are generated at converter screen 14 in response, and proportional to, received X-rays, as is well known, and the light signals are provided to sensor/coupling unit 16. Sensor/coupling unit 16 includes a coupler 18, preferably a fiber optic (FO) coupler such as a fiber optic window (FO-window) or a fiber optic reducer (FO-reducer) with an input face, or portion, 19 engaging the side of converter plate 14 opposite to the side of the converter plate facing the X-ray source. Sensor/coupling unit 16 also includes a sensor 20, preferably a single stage (or multiple stage) charge coupled device (CCD) or, preferably, a time delay integrated (TDI) CCD.

X-ray source 7 is mounted at the pivot end 22 of mounting, or swing, arm 23, and sensor/coupling unit 16 is mounted at the free end 24 of the swing arm. When so mounted, X-ray source 7 is essentially pivoted to effect field of view (FOV) motion, while sensor/coupling unit 16 is moved in an arc below converter screen 14 to effect full FOV coverage (the curvature of the converter screen is the same as the arcuate path of travel of the sensor/coupling unit). In such swing arm systems, the sensor is maintained in register with the X-ray beam and the coupler remains closely adjacent to the converter screen (with the input face of the coupler engaging the converter screen) since the curvature of the converter screen is the same as the arcuate path followed by the sensor/coupling unit.

As indicated in FIG. 1, movement of mounting arm 23 is controlled by actuator unit 26, implemented, for example, by a conventional mechanical and/or motor arrangement. Actuator unit 26 is controlled by control unit 28, which unit also controls sensor 20.

Sensor 20 provides an electrical output signal indicative of the object, or body portion of a patient, then being subjected to X-rays, and the analog output signal is normally converted to a digital signal at digital conversion unit 30, and the digital signal is then typically coupled to an electronic unit, preferably an electronic readout and/or storage unit 32, which unit normally includes a computer 34 having data storage 36 and monitor 38 connected therewith.

Figure 3:
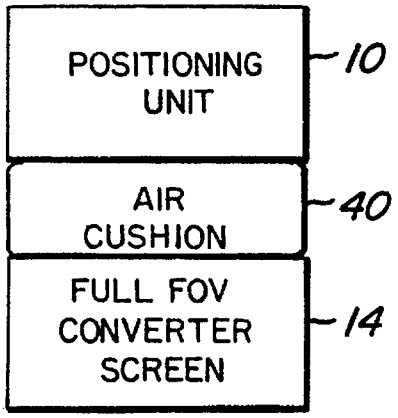
FIG. 3 is a simplified block diagram illustrating use of a cushion (preferably an air cushion) to provide positive engagement between the input face of the coupler and the converter screen.
Figure 4:
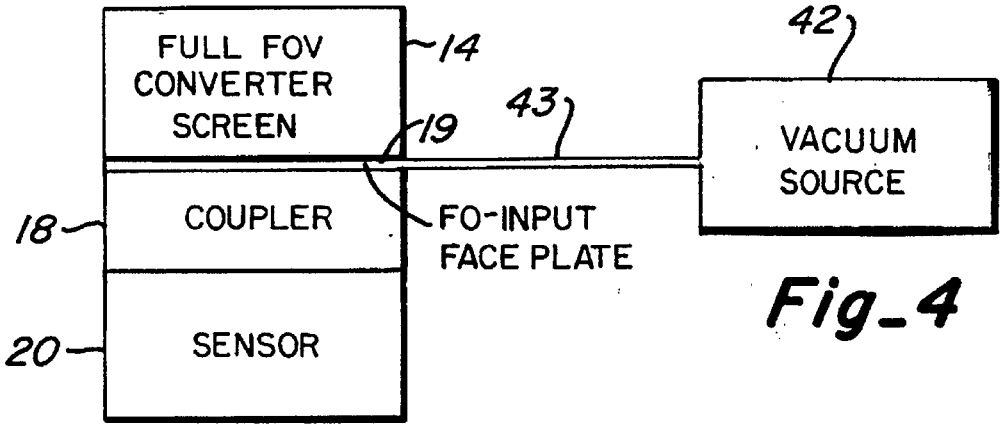
FIG. 4 is a simplified block diagram illustrating use of a vacuum to draw the face plate of the coupler into engagement with the converter screen.
Figure 5:
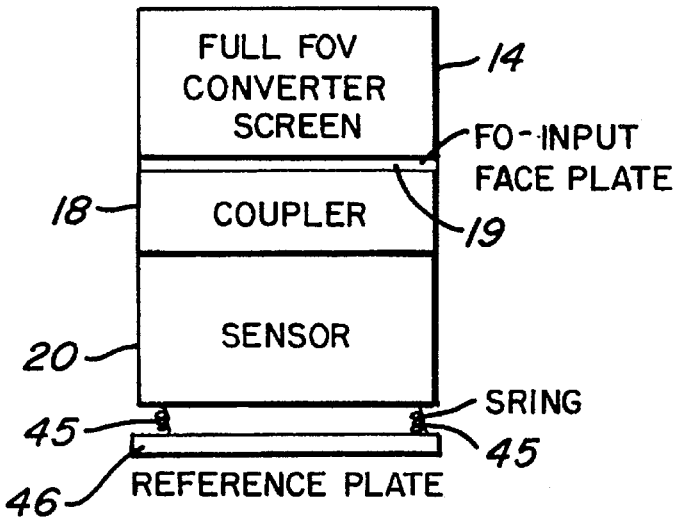
FIG. 5 is a simplified block diagram illustrating use of springs to provide positive engagement between the input face of the coupler and the converter screen.

An air gap between X-ray converter screen 14 and input face 19 of coupler 18 cannot be tolerated since the presence of such an air gap would result in an unacceptable loss of resolution. It is therefore necessary that positive contact, or engagement, between converter screen 14 and input face 19 be maintained throughout the scan. To assure and/or establish positive contact between converter screen 14 and input face 19, a force is provided: to urge the converter screen in a direction toward the input face of the coupler (such as by introducing a cushion, preferably an air cushion, 40 between positioning unit 10 and converter screen 14, as indicated in FIG. 3); to pull the converter screen and the input face toward one another (such as by introducing a vacuum between the converter screen and the input face of the coupler using a vacuum source 42 and tube 43, as indicated in FIG. 4); and/or to bias the sensor/coupling unit toward the converter screen (such as by introducing springs 45 between a reference, plate 46 and the sensor of the sensor/coupling unit, as indicated in FIG. 5).

In some types of systems, such as, for example, in gantry type systems, the X-ray source and sensor/coupler follow a straight line path. In this type of system, the converter screen is also flat, rather than having a curvature as shown in FIG. 2, with the system operating in the same manner with respect to maintaining positive engagement between the fixed converter screen and the input face of the movable coupler.

This invention is not meant to be limited to use in the medical field, but has been found to be useful in medical applications and/or procedures to X-ray predetermined body portions (such as, for example, to X-ray breasts when used in a mammogram system). In addition, this invention is also not meant to be limited to a single, or multiple, CCD or TDI-CCD arrangement, and can be used, for example, with multiple ones of such sensors to obtain stereo or volumetric imaging information. For stereo imaging, two such sensors are utilized, and, for volumetric imaging, three such sensors are utilized.

As can be appreciated from the foregoing, this invention provides a system and method for X-ray imaging wherein signals from a fixed converter screen are coupled to a movable sensor through a movable coupler having an input face maintained in engagement with the converter screen.

What is claimed is:

1. A scan-type X-ray imaging system comprising:

a movable X-ray source providing a directed X-ray output;

a positioning unit for positioning an object at a scan area so that said X-ray output from said X-ray source is directed to said object;

a converter screen receiving X-rays passing through said object at said scan area and providing converted output signals responsive thereto;

a movable sensor/coupling unit including a coupler for coupling said converted output signals from said converter screen, said coupler having an input portion movably engaging said converter screen, and said sensor/coupling unit also having a sensor receiving said converted output signals from said converter screen through said coupler and, responsive thereto, providing electrical signal outputs indicative of said object at said scan area;

an actuator unit connected with said X-ray source and said sensor/coupling unit for causing movement of said X-ray source and for causing movement of said sensor/coupling unit so that said input portion of said coupler is moved relative to said converter screen while maintaining engagement therewith during said movement of said sensor/coupling unit; and a control unit connected with said actuator unit for controlling movement of said X-ray source and said sensor/coupling unit by said actuator unit to thereby effect coverage of a specific field of view at said scan area.

2. The system of claim 1 wherein said actuator unit includes a swing arm having a pivot end and a free end movable in an arc, said X-ray source being mounted adjacent to said pivot end of said swing arm and said sensor/coupling unit being mounted adjacent to said free end of said swing arm.

3. The system of claim 1 wherein said converter screen is a phosphor screen having a size at least as large as said field of view at said scan area.

4. The system of claim 3 wherein said converter screen is a curved membrane mounted on a holder.

5. The system of claim 1 wherein said input portion of said coupler engages one side of said converter screen, and wherein said system includes a force applicator to maintain engagement of said input portion of said coupler with said one side of said converter screen.

6. The system of claim 5 wherein said force applicator is at least one of a cushion, a vacuum source, and springs.

7. The system of claim 1 wherein said coupler is a fiber optic coupler having an input face movably engaging said converter screen.

8. The system of claim 7 wherein said fiber optic coupling is one of a fiber optic reducer and a fiber optic window.

9. The system of claim 1 wherein said sensor includes at least one charge coupled device.

10. The system of claim 1 wherein said system includes an electronic unit receiving said electrical signal outputs from said sensor and, responsive thereto, providing an output indicative of said object at said scan area.

11. The system of claim 1 wherein said object positioned by said positioning unit at said scan area is a predetermined body portion.

12. An X-ray system comprising:

a movable mounting unit;

an X-ray source mounted on said mounting unit for movement therewith, said X-ray source providing a directed X-ray output;

a positioning unit for positioning a predetermined portion of the body of a patient at a scan area so that said X-ray output from said X-ray source is directed to said predetermined body portion;

a converter screen receiving X-rays passing through said predetermined body portion at said scan area and providing converted output signals responsive thereto;

a sensor/coupling unit mounted on said mounting unit for movement therewith, said sensor/coupling unit including a coupler having an input face movably engaging said converter screen and a sensor receiving said converted output signals from said converter screen and, responsive thereto, providing electrical output signals;

an actuator unit connected with said mounting unit for effecting movement of said X-ray sensor and said sensor/coupling unit so that said input face of said coupler of said sensor/coupling unit is moved relative to said converter screen while maintaining engagement with said converter screen during said effected movement of said sensor/coupling unit;

a control unit connected with said actuator unit for controlling movement of said mounting unit by said actuator unit to thereby effect coverage of a specific field of view at said scan area; and an electronic unit receiving said electrical signal output from said sensor of said sensor/coupling unit and providing an output indicative of said predetermined body portion within said field of view at said scan area.

13. The system of claim 12 wherein said converter screen is a phosphor screen having a size at least as large as said field of view at said scan area, and wherein said input face of said coupler engages the side of said converter screen opposite to the side facing said X-ray source.

14. The system of claim 12 wherein said system includes a force applicator to maintain engagement of said input face of said coupler with said converter screen.

15. The system of claim 14 wherein said force applicator is at least one of an air cushion, a vacuum source and springs.

16. The system of claim 12 wherein said coupler is a fiber optic coupler.

17. A method for X-ray imaging, said method comprising:

positioning an object at a scan area;

providing a directed X-ray beam at said predetermined area so that said X-rays pass through said object positioned thereat;

providing a converter screen receiving X-rays passed through said object at said scan area;

providing a movable sensor/coupling unit having a sensor and a coupler with an input face movably engaging said converter screen, said coupler providing output signals from said converter screen to said sensor, and said sensor providing an output signal responsive to receipt of output signals from said converter screen;

moving said sensor/coupling unit so that said input face of said coupler is moved relative to said converter screen to effect a scan of said scan area and maintaining said input face of said coupler in engagement with said converter screen throughout movement of said sensor/coupling unit; and using said output signal from said sensor to provide an image of said object scanned at said scan area.

18. The method of claim 17 wherein said method includes pivoting said X-ray source and moving said sensor/coupling unit in an arc to effect said scan of said object at said scan area.

19. The method of claim 17 wherein said method includes providing a force to maintain said input face of said coupler in engagement with said converter screen.

20. The method of claim 19 wherein said force applied to maintain said input face in engagement with said converter screen is applied by using at least one of an air cushion, a vacuum, and springs.

* * * * *